US006868628B2

(12) United States Patent
Stathis

(10) Patent No.: US 6,868,628 B2
(45) Date of Patent: Mar. 22, 2005

(54) DISPLAY ATTACHMENT FOR SULKY

(76) Inventor: Sam Stathis, 23 Liberty Rd., Demarest, NJ (US) 07627

( * ) Notice: Subject to any disclaimer, the term of this patent is extended or adjusted under 35 U.S.C. 154(b) by 0 days.

(21) Appl. No.: 10/238,135

(22) Filed: Sep. 10, 2002

(65) Prior Publication Data

US 2003/0046844 A1 Mar. 13, 2003

Related U.S. Application Data

(60) Provisional application No. 60/318,397, filed on Sep. 10, 2001.

(51) Int. Cl.[7] ..... G09F 21/04
(52) U.S. Cl. ..... 40/587
(58) Field of Search ..... 40/587

(56) References Cited

U.S. PATENT DOCUMENTS 710,195 A * 9/1902 Jones ..... 40/587
1,054,819 A * 3/1913 Blachshear ..... 40/587
1,500,884 A * 7/1924 Murnin ..... 40/587
3,271,048 A * 9/1966 Beesley et al. ..... 280/204

* cited by examiner

*Primary Examiner*—Cassandra Davis
(74) *Attorney, Agent, or Firm*—Baker Botts LLP

(57) ABSTRACT

An attachment for a racing sulky is provided having a display plate upon which advertisement or other material may be placed for exhibit to the viewers of a race. In one arrangement the display plate is mounted to the hub of the spoke of the sulky wheel by a bearing and it includes a counterweight to maintain it in an upright position when the wheel rotates. In a second arrangement, the plate is supported by a U shaped bracket which extends above the sulky wheel.

5 Claims, 2 Drawing Sheets

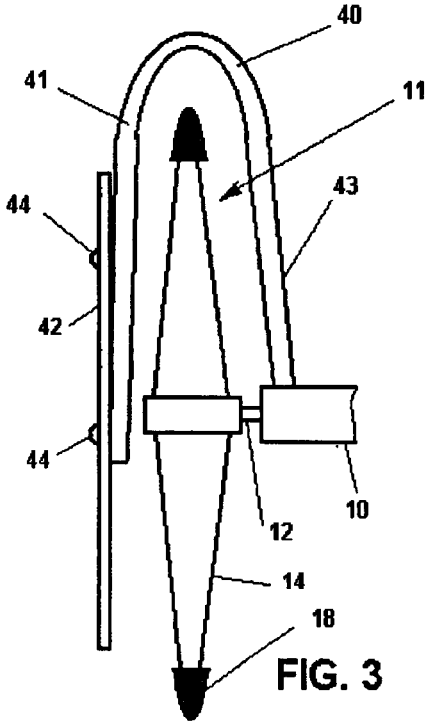
FIG. 3
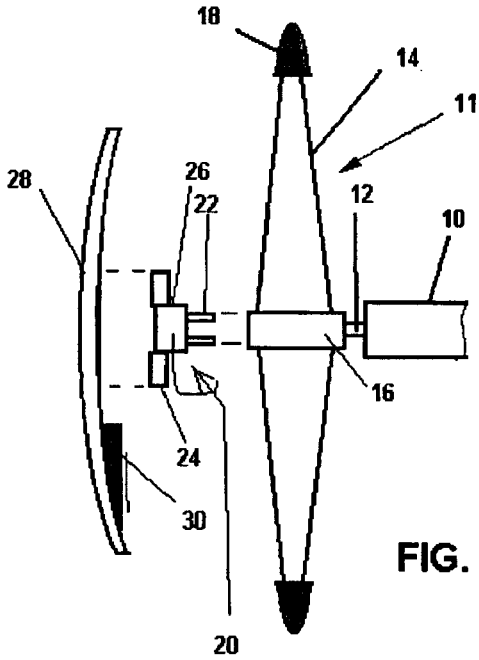
FIG. 1
FIG. 2
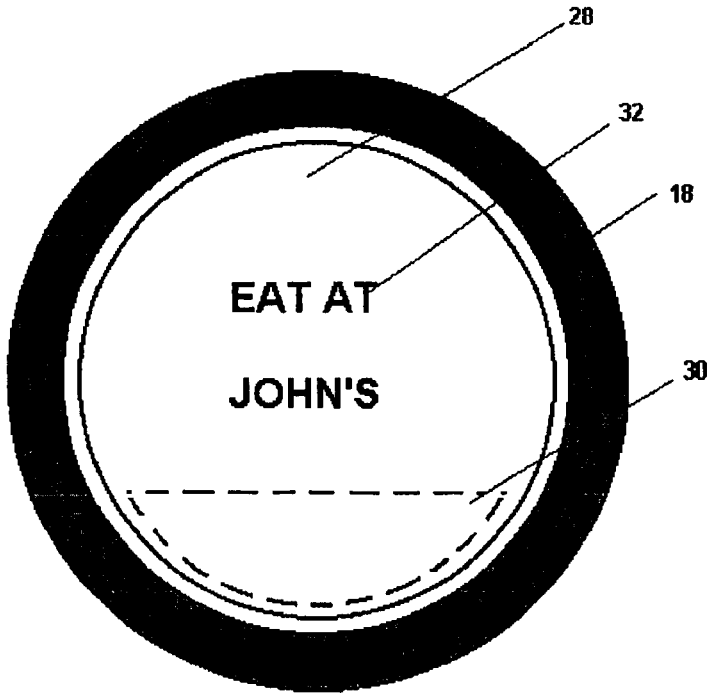

DISPLAY ATTACHMENT FOR SULKY

This application claims the benefit of provisional patent application Ser. No. 60/318,397 filed Sep. 10, 2001.

BACKGROUND OF THE INVENTION

This invention relates to the addition of a display on a racing sulky. The display can be for identification of the entry number in a race or can be an advertising display which can provide incidental advertising messages to the viewing audience at the racetrack or to an audience observing the race over television or closed circuit television.

It is an object of the invention to provide a display attachment on a sulky, which is easily visible to the audience.

SUMMARY OF THE INVENTION

According to a first embodiment of the invention, there is provided an attachment for a sulky for providing a display. The attachment comprises a display plate and an inverted U shape support member having first and second legs. The first leg of the support member is attached to the display plate. The second leg of the support member is attached to a non-rotating structural portion of the sulky with the U shaped support member extending over a wheel of the sulky, such that the display plate is supported in a non-rotating arrangement on the outside of the sulky wheel.

In a preferred arrangement, the display plate is a circular plate arranged centrally with respect to the sulky wheel. The U shaped support member may be attached to an axle of the sulky at a portion thereof inboard of the wheel. The display plate may advantageously include an advertising display on the outside thereof opposite the wheel.

In accordance with the invention there is provided an attachment for a sulky for providing a display, comprising a display plate and a support member connected to a non-rotating structural portion of a sulky. The support member extends over a wheel of the sulky and has a downwardly extending leg arranged exterior of the sulky wheel and connected to the display plate, such that the display plate is supported in a non-rotating arrangement on the outside of the sulky wheel.

According to a further arrangement in accordance with the invention, there is provided an attachment for a sulky which includes a display plate and a supporting member having a first portion mounted to a central portion of the display plate, a second portion mounted to a rotatable portion of a sulky wheel and a bearing inter-connecting the first and second portions. The display plate further includes a counter weight arranged over a selected portion of the periphery of the display plate for maintaining the display plate in a non-rotating condition when the sulky wheel rotates.

The display plate is preferably circular and arranged concentric to the sulky wheel. The display plate may have a convex exterior surface opposite to the support member to thereby fit closely to the sulky wheel. In the case of a convex exterior surface, a concave interior recess may be arranged opposite to the convex surface and the counterweight may be mounted within the convex recess. The second portion of the support member can be mounted to a hub of the sulky wheel. The display plate may advantageously include an advertisement display on a side thereof opposite the wheel, which is exhibited to the audience during a race.

For a better understanding of the present invention, together with other and further objects, reference is made to the following description, taken in conjunction with the accompanying drawings and it's scope will be pointed out in the appended claims.

BRIEF DESCRIPTION OF THE DRAWINGS

FIG. 1 is a cross-sectional view showing a first arrangement of a sulky attachment in accordance with the present invention.

FIG. 2 is a side view of a sulky wheel with the attachment of FIG. 1.

FIG. 3 is a cross-sectional view showing a second embodiment of a display for a sulky wheel in accordance with the present invention.

DESCRIPTION OF THE INVENTION

Figure 4:
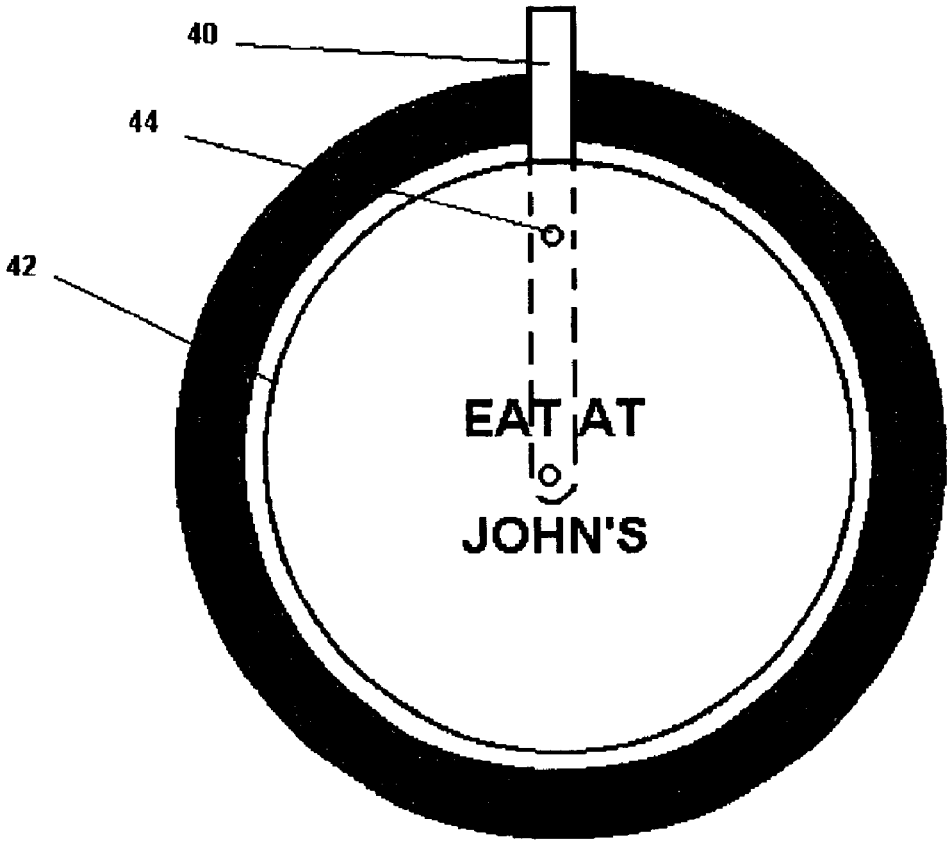
FIG. 4 is a side view of the sulky attachment shown in FIG. 3.

FIGS. 1 and 2 illustrate a first embodiment of the invention. FIG. 1 is a cross-sectional view showing a sulky wheel 11 having a hub 16, spokes 14 and a peripheral tire 18. The sulky wheel is mounted on an axle 12 by hub 16. Axle 12 is affixed to a frame 10 of the sulky. In accordance with the invention, there is provided an attachment to the sulky which includes a support member 20 having a first portion 24 which is attached to a display plate 28 near the center thereof. A second portion 26 of the support member is connected to a rotatable portion the wheel 11 of the sulky, preferably by a clip 22. First portion 24 is connected to second portion 26 of the support member with a bearing such that the two members are free to rotate with respect to each other. Thus the first portion 24, can remain stationary with display plate 28 while second portion 26 rotates with the rotation of the sulky wheel. A counterweight 30 is provided on a portion on the periphery of display plate 28 to provide an off-center weight to keep display plate 26 in a vertical orientation as shown in FIG. 2 while the sulky wheel 11 is rotating. Preferably counterweight 30 is arranged in a recess formed in the concave inner side of display plate 28 which includes a convex exterior surface on which a display 32 may be provided. The display 32 may be an advertisement display, or alternately can be an identification of the stable from which the sulky originates, or alternately can be a display of the number assigned to the entry in a race for purposes of making viewing of the race progress easier for the audience or a television audience.

Referring to FIGS. 3 and 4, there is shown a second embodiment of the invention. In the cross-sectional view of FIG. 3, there is shown a U shaped bracket 40, which includes a first leg 41 attached to a display plate 42 by screws or rivets 44 and a second leg 43 attached to the frame 10 of the sulky. The attachment may be to the axle, as shown in FIG. 3, or to other supporting structural members of the sulky. In the embodiment shown in FIGS. 3 and 4, the U-shaped bracket on which display plate is 44 is mounted, extends up and over the wheel of the sulky to provide a fixed orientation with respect to the sulky frame and a similar display of the outer surface of display plate 42 to the viewing audience.

While there have been described what are believed to be the preferred embodiments of the invention, those skilled in the art that other and further changes and modifications may be made thereto without departing from the spirit of the invention, and it is intended the claim all such changes and embodiment as for within the true scope of the invention.

I claim:

1. An attachment for a racing sulky for providing a display, comprising a display plate, an inverted U-shaped support member having first and second legs, wherein said first leg is connected to said display plate and said second leg is connected to a non-rotating structural portion of a racing sulky with said U-shaped support member extending over a wheel of said racing sulky, such that said display plate is supported in a non-rotating arrangement and further such that said second leg of said U-shaped support member is the only portion of said attachment which is directly connected to said racing sulky.

2. An attachment as specified in claim 1, wherein said display plate is a circular plate.

3. An attachment as specified in claim 1, wherein said U-shaped support member is attached to an axle of said racing sulky at a portion thereof inboard of said wheel.

4. An attachment as specified in claim 1, wherein said display plate includes an advertisement display on a side thereof opposite said wheel.

5. An attachment for a racing sulky for providing a display, comprising a display plate and a support member connected to a non-rotating structural portion of a racing sulky, said support member extending over a wheel of said racing sulky and having a downwardly extending leg arranged exterior of said racing sulky wheel and connected to said display plate, such that said display plate is supported in a non-rotating arrangement on the outside of said racing sulky wheel, and further wherein said support member connected to a non-rotating structural portion of said racing sulky is the only member of said attachment which is connected to said racing sulky.

* * * * *